US006681826B1

(12) United States Patent
Biagiotti

(10) Patent No.: US 6,681,826 B1
(45) Date of Patent: Jan. 27, 2004

(54) DEVICE FOR THE PRODUCTION OF MULTI-PLY WEB MATERIAL WITH DIFFERENT SIZE AND DENSITY PATTERNS ON DIFFERENT PLIES

(75) Inventor: Guglielmo Biagiotti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 09/980,939

(22) PCT Filed: Jun. 9, 2000

(86) PCT No.: PCT/IT00/00237

§ 371 (c)(1),
(2), (4) Date: Dec. 6, 2001

(87) PCT Pub. No.: WO00/78533

PCT Pub. Date: Dec. 28, 2000

(30) Foreign Application Priority Data

Jun. 18, 1999 (IT) ..... FI99A0144

(51) Int. Cl.[7] ..... B31F 1/07
(52) U.S. Cl. ..... 156/470
(58) Field of Search ..... 56/209, 470, 219, 56/459; 162/109

(56) References Cited

U.S. PATENT DOCUMENTS

| | | | | |
|---|---|---|---|---|
| 3,414,459 A | | 12/1968 | Wells | |
| 3,694,300 A | | 9/1972 | Small | |
| 3,961,119 A | | 6/1976 | Thomas | |
| 4,320,162 A | | 3/1982 | Schulz | |
| 4,978,565 A | | 12/1990 | Pigneul et al. | |
| 5,096,527 A | | 3/1992 | Biagiotti | |
| 5,173,351 A | | 12/1992 | Ruppel et al. | |
| 5,736,223 A | | 4/1998 | Laurent | |
| 5,830,558 A | * | 11/1998 | Barnholtz | 428/694 B |
| 5,906,711 A | * | 5/1999 | Barnholtz | 162/132 |
| 6,136,413 A | * | 10/2000 | Le Port et al. | 428/154 |

FOREIGN PATENT DOCUMENTS

| | | | |
|---|---|---|---|
| GB | 1 225 440 | | 3/1971 |
| WO | WO 96/18771 A1 | | 6/1996 |
| WO | WO 97/20687 A1 | | 6/1997 |
| WO | WO 97/20688 A1 | | 6/1997 |
| WO | WO 97/20689 A1 | | 6/1997 |
| WO | WO97/27365 | * | 7/1997 |
| WO | WO 99/44814 A1 | | 9/1999 |

* cited by examiner

*Primary Examiner*—Michael W. Ball
*Assistant Examiner*—Barbara J Musser
(74) *Attorney, Agent, or Firm*—Breiner & Breiner, L.L.C.

(57) ABSTRACT

The embossing device comprises in combination: a first embossing unit (1) with a first embossing cylinder (3) provided with a first set of points (3P) and interacting with a first pressure cylinder (5) for forming, on a first ply (V1), a first set of protuberances (V1p) having small sizes and a high density; a second embossing unit (7) with a second embossing cylinder (9) provided with a second set of points (9P) and interacting with a second pressure cylinder (11) and a laminating cylinder (13), for forming, on a second ply (V2), a second set of protuberances (V2p) having larger sizes and a lower density than the protuberances of the first set; an adhesive dispenser (15) for applying an adhesive to one of said plies before lamination.

6 Claims, 2 Drawing Sheets

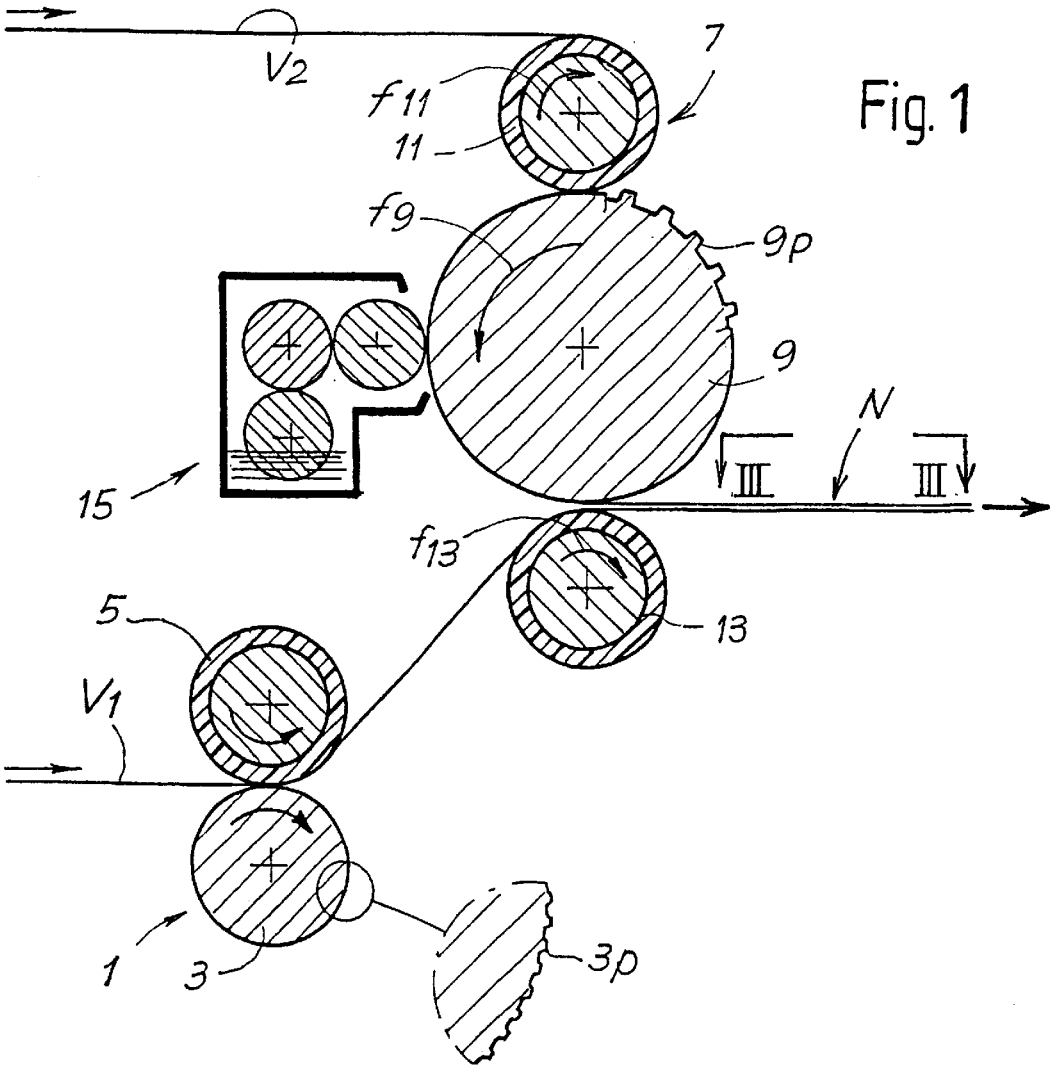
Fig. 1
Fig. 2
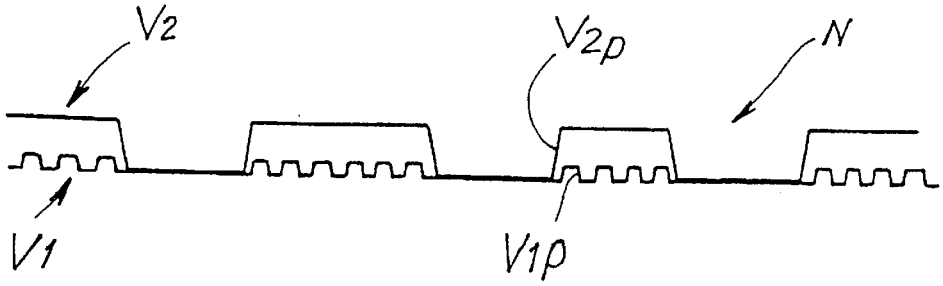

DEVICE FOR THE PRODUCTION OF MULTI-PLY WEB MATERIAL WITH DIFFERENT SIZE AND DENSITY PATTERNS ON DIFFERENT PLIES

TECHNICAL FIELD

The present invention relates to a method and a device for embossing plies of web material, particularly, but not exclusively, plies of paper, tissue paper, and the like, for the production of articles made from multi-ply web material and consisting of two or more plies which are embossed and joined together.

The invention also relates to a manufactured article consisting of two or more plies which are embossed and joined together.

BACKGROUND ART

In the production of this type of manufactured article, it is necessary to meet various requirements relating to the production, appearance and functionality of the end product, which requirements sometimes conflict with each other. For example, one of the problems which arises in the production of embossed web materials wound in rolls consists in the tendency of the individual turns of the material to become nested in each other. This creates a problem in respect of production and also a drawback in the finished product, in that the presence of embossing nested in adjacent turns in the finished roll is perceived by the user as a defect in the end product.

Furthermore, one of the requirements which the embossing process must meet is that of obtaining a high volume of the end product. It is therefore desirable to carry out embossing which, in a way compatible with the other production requirements, imparts a high volume to the finished article.

The embossed sheet web material is used for the production of kitchen towels, toilet paper, serviettes, paper tissues, and the like. In general, this web material consists of two or more plies which are usually embossed separately from each other and subsequently joined together, usually by means of an adhesive or also by other methods, such as ply-bonding. Sheet products having a particular softness and thickness, and good liquid-absorption characteristics, are produced in this way.

The embossing and the joining of two or more plies is normally carried out by one of two methods, called "tip-to-tip" and "nested" embossing. In the first case, two plies of embossed material are joined by lamination between two embossing cylinders with counter-rotating parallel shafts. The two cylinders are provided with points which match each other, at least partially, in a laminating gap formed at the point of tangency between the two cylinders. An adhesive is applied to the protuberances of one of the two embossed plies to provide permanent joining to the other ply at the positions of the protuberances of the other ply in the areas in which the points of the two embossing cylinders coincide with each other. Examples of embossing machines of this type are described in U.S. Pat. No. 3,414,459, U.S. Pat. No. 4,978,565, U.S. Pat. No. 5,173,351, U.S. Pat. No. 5,096,527, U.S. Pat. No. 3,961,119, WO-A-9720687, WO-A-9720688, WO-A-9720689.

In other devices, the plies are joined in such a way that the protuberances of one ply are nested in the cavities between adjacent protuberances of the other ply. In this case, the two embossing cylinders are not pressed against each other at the positions of the corresponding points, and the two plies are joined together by laminating with a pressure roller which interacts with the surface of one of the embossing cylinders, on which both plies are supported as they emerge from the gap between the embossing cylinders.

Examples of this type of embossing are described and illustrated in GB-A-1,225,440 and U.S. Pat. No. 3,694,300.

Normally, the embossing, whether of the tip-to-tip or the nested type, consists of a geometrical and uniform distribution of protuberances, typically of truncated conical or truncated pyramidal shape, over the two plies. To obtain a product with a more attractive appearance, systems in which protuberances of various shapes are combined with each other to obtain a particular design have been conceived. For example, U.S. Pat. No. 4,320,162 describes an embossing system in which embossing, consisting of a geometrical and uniform distribution of small protuberances arranged with a high density, forming a fine background embossing, combined with a low-density distribution of protuberances of complex shape and of larger size, forming a decorative motif, is produced on each of the two plies. A similar product is described in WO-A-9618771.

A disadvantage of this system consists in the fact that when it is desired to change the decorative motif it is necessary to make a new pair of embossing cylinders, or at least one new embossing cylinder, which means that not only the whole of the decorative motif but also all the points of the cylinder producing the background embossing have to be formed again.

OBJECTS AND BRIEF DESCRIPTION OF THE INVENTION

The object of the present invention is to provide a method and a device for producing an embossed multi-ply web material of particularly good quality. More particularly, an object of the present invention is to provide a method and a device which can be used to obtain a product of high volume.

A further object of the present invention is to provide a method and a device which can be used to obtain a product which, when wound in a roll, does not give rise to the interpenetration of the embossed design between a number of overlapping turns.

Yet another object of the present invention is to provide a method and a device which can be used to obtain an article in which the two or more embossed plies are joined together by an adhesive, and in which the quantity of adhesive required is relatively limited, in order to avoid excessive stiffening of the end product.

Yet a further object of the present invention is to provide a product which is particularly soft and plump to the touch.

These objects and advantages, and others, which will be evident to persons skilled in the art from a reading of the following text, are achieved essentially by means of an embossing device comprising, in combination:

- a first embossing unit with a first embossing cylinder provided with a first set of points and interacting with a first pressure cylinder for forming, on a first ply, a first set of protuberances having small sizes and a high density;
- a second embossing unit with a second embossing cylinder provided with a second set of points and interacting with a second pressure cylinder and a laminating cylinder, for forming, on a second ply, a second set of protuberances having larger sizes and a lower density than the protuberances of the first set;

an adhesive dispenser for applying an adhesive to one of said plies before laminating.

In practice, the second pressure cylinder has a yielding cylindrical surface, and the laminating cylinder has a cylindrical surface of greater hardness than the surface of the second pressure cylinder. Thus the first ply does not undergo a second embossing, but only a flattening of the first embossing where it meets the points of the second embossing.

The points of the first embossing cylinder have a greater density and smaller size than the points of the second embossing cylinder.

The invention also relates to a method for the production of a multi-ply web material, consisting of at least two embossed plies joined together, comprising the steps of:

embossing a first ply, by forming a first set of protuberances of limited size and high density on it;

embossing a second ply, by forming a second set of protuberances having larger sizes and a lower density than the first protuberances;

applying an adhesive between said two plies;

laminating the two plies together and joining them by gluing.

In practice, according to a particularly advantageous embodiment of the invention, the second ply is embossed between an embossing cylinder and a pressure cylinder having a yielding outer surface; the two embossed plies are laminated between the embossing cylinder and a laminating cylinder, whose outer surface has a greater hardness than that of said pressure cylinder.

Advantageously, the adhesive is applied to the extremities of at least some of the protuberances of said second set of protuberances formed on the second ply while said second ply is still engaged on the second embossing cylinder. To limit the quantity of adhesive applied, it is possible to arrange for it to be distributed on only some of said protuberances and not on all of them, for example by means of a patterned dispensing cylinder, or by using protuberances 9P of different heights.

By means of the method according to the invention, an embossed web material comprising at least two embossed plies joined together is obtained. A first of said two plies has a first set of protuberances, and the second of said two plies has a second set of protuberances facing the interior of the web material; the protuberances of the second set have larger sizes and a lower density than the protuberances of the first set, and the two plies are glued together at the positions of at least some of said second protuberances. The protuberances of the first set impart the technical characteristics of thickness, and therefore of volume, to the material, while the second protuberances provide the visual characteristics of the product, which can thus be personalized by maintaining a base pattern formed by the protuberances of the first set, and a motif, variable from one product to another, consisting of the set of protuberances of the second set.

Further advantageous features of the device, the method and the product according to the invention are indicated in the attached claims.

The presence of a micro-embossed ply, in other words one provided with protuberances having small sizes and a high density, typically equal to or greater than 30 points/cm2, makes it possible to obtain a product which, when wound in rolls, does not give rise to nesting between consecutive turns. The winding is carried out with the ply provided with the small protuberances facing the interior of the roll, while the protuberances of the second set, which form the decorative motif, face the exterior and are therefore clearly visible on the product.

Additionally, the micro-embossing imparts a high degree of plumpness and softness to the article, while the volume of the article is particularly high because of the presence of the embossing on the two plies and because of the joining of the two plies, which is essentially free of nesting.

BRIEF DESCRIPTION OF THE DRAWINGS

The invention will be more clearly understood from the description and the attached drawings, which show an embodiment of the invention provided by way of example and without restrictive intent. More particularly:

FIG. 1 is a schematic lateral view of a device according to the invention;

FIG. 2 shows a greatly enlarged and schematic detail of a section through the web material produced by means of the device in FIG. 1;

DETAILED DESCRIPTION OF THE PREFERRED EMBODIMENT OF THE INVENTION

Figure 3:
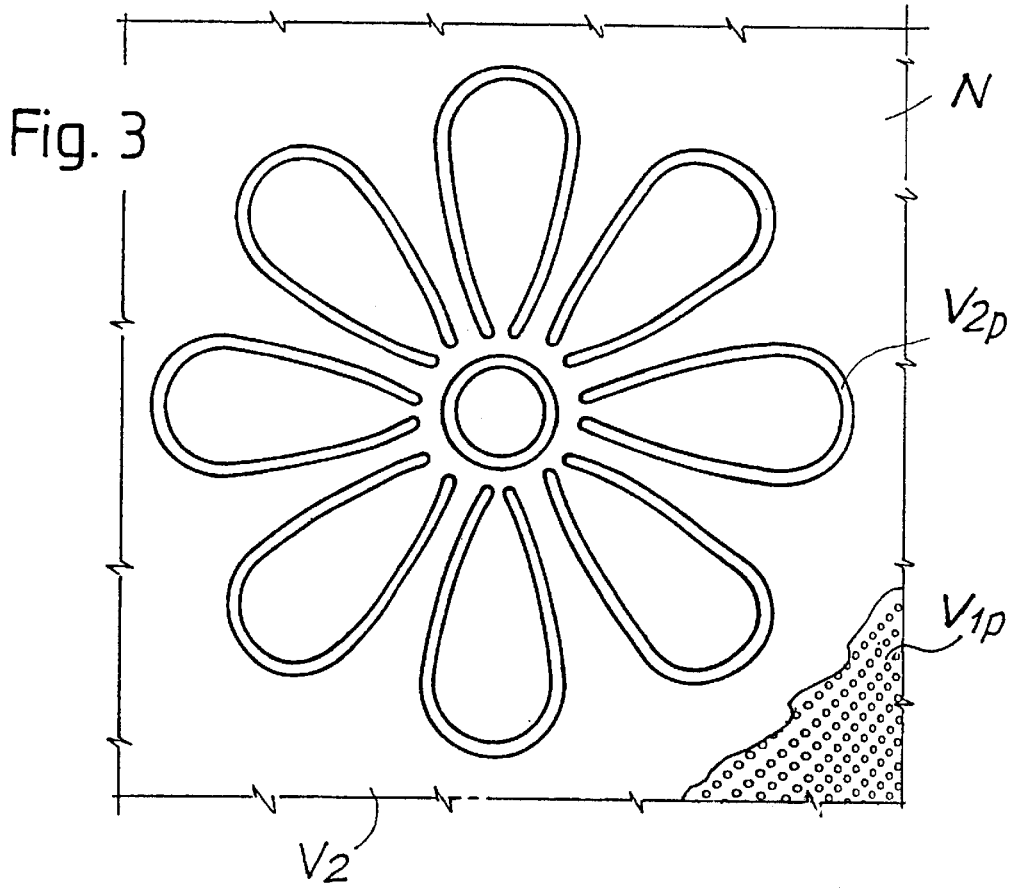
FIG. 3 is a view from above on the plane III—III in FIG. 1 of a portion of the web material N.

FIG. 1 is a diagram in the form of a side view of a device according to the invention. The embossing device has a first embossing unit 1, comprising a pair of cylinders 3, 5 of which the cylinder 3 is made from steel or other hard material, and the other is preferably smooth and covered with yielding material such as rubber or the like. The cylinder 3 is covered with points or protuberances 3P arranged, for example, in a geometrical pattern consisting of helical alignments. The points, which can typically be of truncated conical or truncated pyramidal shape, have a high density, typically equal to or greater than approximately 30 points per cm2.

The device also has a second embossing unit, indicated overall by 7, comprising an embossing cylinder 9 made from steel or other material, provided with a plurality of points or protuberances 9P, having larger sizes and a lower density than the points of the cylinder 3. The embossing cylinder 9 rotates in an anti-clockwise direction (arrow f9) and interacts with a pressure cylinder 11, rotating in a clockwise direction (arrow f11). The pressure cylinder 11 is preferably covered with yielding material, for example rubber or the like.

The embossing cylinder 9 also interacts with a laminating cylinder 13, rotating in a clockwise direction as shown by the arrow f13, and provided with a smooth surface whose hardness is greater than the hardness of the surface of the pressure cylinder 11. The laminating cylinder 13 may in practice have a surface made from steel or from rubber of greater hardness than the rubber which covers the cylinder 11.

The embossing cylinder 9 interacts with an adhesive dispenser 15, which applies an adhesive, in the way described below, to one of the plies fed to the embossing device.

The points 9P of the embossing cylinder 9 can advantageously be formed on an interchangeable sleeve which can be fitted on an inner core of the cylinder. It thus becomes particularly easy to replace the points 9P, with the possibility of changing the pattern formed on the embossed product, while the points 3P of the first embossing cylinder 3 remain identical when a change is made from one product to another.

The device which has been briefly described operates as follows. A first ply V1 is fed to the first embossing unit 1 and is embossed between the cylinders 3, 5, receiving a micro-embossing design with protuberances corresponding to the points 3P of the embossing cylinder 3. The ply V1 micro-embossed in this way is fed into the nip between the embossing cylinder 9 and the laminating cylinder 13, where it is joined to a second ply V2 in the way which is described below.

The second ply V2 is fed around the pressure cylinder 11 and is embossed between the pressure cylinder 11 and the embossing cylinder 9; thus it is deformed according to a pattern corresponding to the points 9P of the embossing cylinder 9. An adhesive is applied by means of the dispenser 15 to the portions of the ply V2 which are located on the highest projecting surfaces of the points 9P (or on some of them). After being embossed and having adhesive applied to it in this way, the ply V2 is made to pass between the embossing cylinder 9 and the laminating cylinder 13.

The joining is carried out by gluing at the positions of at least some of the protuberances generated on the ply V2 by the points 9P of the embossing cylinder 9.

The web material N which is obtained at the exit from the embossing device has the structure shown schematically in the enlargement in FIG. 2. The second ply V2 has a set of protuberances V2p, of relatively large size, which form a personalized design, while the first ply V1 has micro-protuberances V1p which are flattened where they meet the protuberances V2p, where the two plies have been laminated and glued.

The protuberances V2p, and consequently the points 9P which generate them, can be of any shape. They can be protuberances of geometrical shape, for example truncated conical, truncated pyramidal or similar shape. Preferably, however, they consist of linear decorative designs, developed over a broad surface, as illustrated schematically in FIG. 3, which shows a plan view of the embossed web material from the side of the ply V2, with a portion cut away where the underlying ply V1 is visible.

Figure 4:
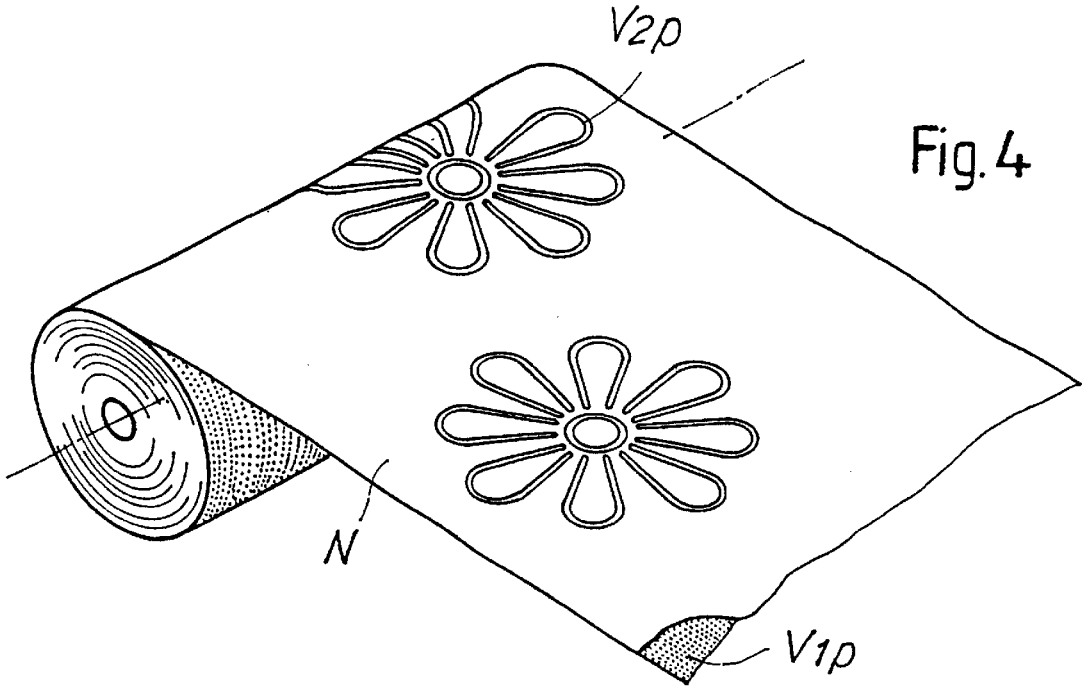
FIG. 4 is a schematic perspective view of a web material wound into a roll.

In general, the size and density of the protuberances V2p will be very different from the size and density of the protuberances V1p, which, in the finished product wound into rolls, will face the interior of the roll and will therefore be invisible, but which will impart the technical characteristics of softness and thickness to the product. The small size and the high density of the protuberances V1p prevents the nesting of the protuberances between adjacent turns of the wound material. The design formed by the second set of protuberances V2p will be visible from the outside of the roll and will thus impart a particularly pleasing appearance to the end product. The positions of the plies V1 and V2 in the product wound into a roll is shown in particular in FIG. 4.

The plies V1 and V2 can be individual plies or can, in turn, be formed front multiple plies. It is also possible for one or more additional smooth or embossed plies to be inserted between the two plies V1 and V2.

The design formed by the protuberances V2p on the second ply can be suitably centered, in a known way, with respect to the transverse lines of perforation which are formed on the web material N after the embossing, in such a way as to provide a product of particularly pleasing appearance.

It is to be understood that the drawing shows only a possible embodiment of the invention, which may vary in its forms and arrangements without departure from the scope of the essential concept of the invention. The presence of any reference numbers in the attached claims has the sole purpose of facilitating the reading of the claims with the aid of the preceding description and of the drawings, and does not limit the scope of protection of the claims.

What is claimed is:

1. An embossing device for producing an embossed web material comprising at least two plies which are embossed and joined together, comprising a first embossing unit including a first embossing cylinder having a first set of protrusions, and a first pressure cylinder which interacts with said first embossing cylinder to form on a first ply a first set of embossments having a first size and a first density;

a second embossing unit including a second embossing cylinder having a second set of protrusions, and a second pressure cylinder which interacts with said second embossing cylinder to form on a second ply a second set of embossments having a second size, said second size being larger than said first size, and a second density, said second density being lower than said first density;

a laminating cylinder interacting with said second embossing cylinder to form a nip to receive said first ply and said second ply after having said first embossments and said second embossments, respectively, formed thereon, and said laminating cylinder and said second embossing cylinder further interacting to flatten embossments of said first embossments which are in correspondence with embossments of said second embossments as the first ply and the second ply move through said nip; and an adhesive dispenser for applying an adhesive to one of said first ply or said second ply prior to receipt in said nip.

2. Device as claimed in claim 1, wherein protuberances of said first set of protuberances impart structural features to the web material and protuberances of the second set of protuberances provide an ornamental motif to the web material.

3. Device as claimed in claim 1, wherein said adhesive dispenser is associated with the second embossing cylinder for applying an adhesive to said second ply.

4. Device as claimed in claim 1, wherein said second pressure cylinder has a yielding cylindrical surface, and wherein said laminating cylinder has a cylindrical surface of greater hardness than the yielding cylindrical surface of the second pressure cylinder.

5. Device as claimed in claim 1, wherein the first density is equal to or greater than 30 protrusions per $cm^2$.

6. Device as claimed in claim 1, wherein protrusions of said first set of protrusions have a truncated conical shape or a truncated pyramidal shape.

* * * * *